US007906716B1

(12) United States Patent
Wiessmeyer

(10) Patent No.: US 7,906,716 B1
(45) Date of Patent: Mar. 15, 2011

(54) MUTE FOR BOWED STRINGED INSTRUMENTS

(76) Inventor: Paul Wiessmeyer, Weymouth, MA (US)

( * ) Notice: Subject to any disclaimer, the term of this patent is extended or adjusted under 35 U.S.C. 154(b) by 0 days.

(21) Appl. No.: 12/657,245

(22) Filed: Jan. 15, 2010

Related U.S. Application Data

(60) Provisional application No. 61/145,770, filed on Jan. 20, 2009.

(51) Int. Cl.
*G10D 3/04* (2006.01)

(52) U.S. Cl. ..... 84/310; 84/311; 84/273

(58) Field of Classification Search ..... 84/310, 84/311, 273
See application file for complete search history.

(56) References Cited

U.S. PATENT DOCUMENTS

| | | | | | |
|---|---|---|---|---|---|
| 433,192 | A | * | 7/1890 | Amme | 84/310 |
| 480,578 | A | * | 8/1892 | Genese | 84/310 |
| 1,125,929 | A | * | 1/1915 | Andraud et al. | 84/310 |
| 1,333,827 | A | * | 3/1920 | Badalamenti | 84/310 |
| 1,344,968 | A | * | 6/1920 | Vanderhoof | 84/310 |
| 1,483,334 | A | * | 2/1924 | Cherniavsky | 84/311 |
| 1,508,830 | A | * | 9/1924 | Zahn | 84/283 |
| 1,549,946 | A | * | 8/1925 | Woelber | 84/310 |
| 1,721,826 | A | * | 7/1929 | Longiaru | 84/311 |
| 1,843,444 | A | * | 2/1932 | Chapin | 84/310 |
| 2,175,007 | A | * | 10/1939 | Warner | 84/311 |
| 2,229,189 | A | * | 1/1941 | Rice | 84/726 |
| D126,040 | S | * | 3/1941 | Alemany | D17/20 |
| 2,265,456 | A | * | 12/1941 | Sofo | 84/311 |
| 2,475,055 | A | * | 7/1949 | Schuh | 84/310 |
| 2,647,428 | A | * | 8/1953 | Nyhagen | 84/310 |
| 2,689,499 | A | * | 9/1954 | Shuman | 84/310 |
| 3,489,051 | A | * | 1/1970 | Weiss | 84/311 |
| 4,667,560 | A | * | 5/1987 | Jablonski | 84/310 |
| 4,773,296 | A | * | 9/1988 | Bech | 84/310 |
| 2009/0007753 | A1 | * | 1/2009 | Hsu | 84/310 |

* cited by examiner

*Primary Examiner* — Elvin G Enad
*Assistant Examiner* — Robert W Horn
(74) *Attorney, Agent, or Firm* — William Nitkin

(57) ABSTRACT

A three-position mute for use with a musical stringed instrument, such mute having an elongated body with two pairs of legs extending therefrom, a slot defined between each pair of legs, a pair of notches defined in the bottom of the elongated body, such notches for engagement with selected strings of the musical instrument in selected modes of use and the slots for engagement on the musical instrument's bridge in a selected mode of use, such modes of use including a bridge engagement position in a first mode of use, a bridge-contacting position in a second mode of use, and a resting position with the mute installed on the strings between the bridge and the tailpiece.

4 Claims, 5 Drawing Sheets

MUTE FOR BOWED STRINGED INSTRUMENTS

This application claims priority and benefit of a provisional patent application entitled Mute for Bowed Stringed Instruments, Application No. 61/145,770 filed Jan. 20, 2009, now pending.

BACKGROUND OF THE INVENTION

1. Field of the Invention

The device of this invention resides in the field of sound-dampeners for musical instruments and more particularly relates to a detachable mute for violins, violas and cellos for reducing the transmissive capability of the bridge.

2. History of the Prior Art

Instrument mutes have been employed for the purpose of altering an instrument's tone and volume. The volume is the level of audible tone and is commonly measured in decibels (dB). Tone is defined as the combination of frequencies produced by the musical instrument. Different instruments have distinctive tonal qualities based on a series of physical parameters including the construction of the instrument and the way it is played by the musician. A combination of tone and volume combine to create the sound palette of each musical instrument.

A musician is always seeking new means to broaden the sound palette of an instrument. A wide variety of mute designs exist to achieve the goal of altering the sound palette of the musical instrument. As a result, mute designs generally encompass two aspects important to the musician: functionality and range of use. Functionality describes the ability of the mute to achieve the desired sound palette change as well as the ease of use or skill level required by the musician to achieve the desired effect. Of special importance to the musician is his/her ability to be able to quickly move the mute in and out of muting positions during the performance of a musical passage. Range of use is the ability of the mute to create multiple sound palette changes depending on how the mute is used by the musician.

Bridge emplacement mutes function by reducing the transmissive capability of the instrument bridge. The instrument bridge is the transmissive column between the strings of the instrument and the body of the instrument. The strings of the musical instrument are bowed or plucked by the musician to produce vibrations. The vibrations are amplified by the body of the instrument.

In this case, the body of the instrument is a violin, viola or cello body and each instrument has four strings. The bridge connects the strings to the body of the instrument and is the main transmissive channel carrying the vibrations of the strings to the amplifying body of the instrument. The bridge rests between the fingerboard of the instrument and the tailpiece of the instrument. The tailpiece is the anchoring point for the instrument strings, and the fingerboard is the portion of the instrument where the musician is able to alter the vibrating lengths of the strings with his or her fingers.

The sound palette change is dependent on the placement of the mute in relation to the instrument bridge as well as the mute's shape and composition. Prior art mutes are commonly constructed from rubber, wood, leather or metal. Other less common materials include bone and plastic composites. Rubber and metal generally produce a dull tone in comparison to leather and wood. Wood and leather, however, tend to be harder to work with during the manufacturing process. Bone mutes are generally custom-made productions. Plastic mutes are beginning to compete with rubber mutes because of plastic's molding advantages during the manufacturing processes.

All mutes are currently one or two-position mutes and are designed in a first position to produce a one sound palette change and in the second position for storing. Thus they can only be used in one specific mode in relation to the bridge to affect the sound of the instrument. Furthermore, many mutes when not in use must be removed from the instrument or clumsily fastened into a resting position on the instrument, making them difficult and undesirable to use during certain passages in musical compositions. The weight of the mute may also become a factor when the mute is used for a longer period of time. Finally, the mute must produce an aesthetically pleasing sound palette change. As a result, musicians and instrument builders have long sought a means of diversifying the functionality and range of use of the mute. Frequently composers and conductors dictate when to use the mute during the performance of a musical composition. It is the responsibility of the player to implement usage of the mute at that moment that the composer/conductor so indicates without interrupting the flow of the music. Very often little regard is given as to how much time it takes to place the mute in position.

U.S. Pat. No. 3,552,255 to Kaston (1971) is a typical example of a simple two-position mute which is attached between the middle strings. The mute either can be hooked over the top of the bridge when in use and slid back between the middle strings when not in use, or can be notched onto one of the strings via a slit in the body of the mute. The disadvantage of the Kaston mute is that it is prone to falling off when not secured through the slit notch. However, this securing is difficult to accomplish in the middle of a performance, and sometimes this type of mute will rattle on the strings.

U.S. Pat. No. D126,040 to Alemany (1941) is a design patent showing a unique curved pattern adapted to a clip-on mute. The mute functions similarly to the Kaston mute. Related patents are U.S. Pat. No. 6,872,875 to Hollander (2005); U.S. Pat. No. D63,710 to Duff (1924). Similar clip-on mute utility patents include U.S. Pat. No. 2,483,268 to Fawick (1949); U.S. Pat. No. 759,375 to Istas (1904); and U.S. Pat. No. 4,449,438 to Goldner (1984). These mutes all suffer from the disadvantage of producing only one tonal variation and being difficult to manipulate during the middle of a performance.

U.S. Pat. No. 4,773,296 to Bech (1988) is a two-position mute that clips over the top of the bridge and uses the A and D strings as sliding guides. When not in use, the Bech mute employs a magnet to hold the mute in the resting position. The Bech mute provides an improved retention mechanism that reduces rattling, but it can only be employed to produce one tonal variation. Furthermore, the magnetic retention mechanism may interfere with the fine tuners installed on the tailpiece of some instruments.

U.S. Pat. No. 2,175,007 to Warner (1939) describes a two-position mute which is attached onto the top of the instrument bridge when in use and is held in the resting position against the tailpiece by a rubber band retention system. The mute only produces one tonal change, and the mute cannot be quickly removed from the instrument once installed.

U.S. Pat. No. 5,347,906 to Geiger (1994) is a cloth bag mute which is attached above the bridge onto the strummed or plucked instrument strings and must be removed from the instrument when not in use. The Geiger mute is the only mute that offers a significant range, depending on where the mute is placed on the instrument's strings and the amount of tension used to hold the bag on top of the strings. U.S. Pat. No.

1,518,935 to Kozelek (1924) uses a cloth strand member which is placed between the strings and the fingerboard when muting is desired and which is removed from the instrument when not in use. Both the Kozelek and Geiger mutes are bulky and must be removed from the instrument when not in use.

U.S. Pat. No. 3,440,917 to Lemon (1969) is an example of a fixed mute which is attached to the strings below the bridge and utilizes a clamping mechanism to attach to the top of the bridge when muting is required. U.S. Pat. No. 4,173,165 to Rhodes (1979) and U.S. Pat. No. 2,863,350 to Si-Hon Ma (1958) feature similar clamping and muting mechanisms. These mutes have a somewhat bulky retention mechanism and are only capable of creating one tonal change. Furthermore, they are difficult to install and cannot be quickly removed during a performance.

U.S. Pat. No. 4,667,560 to Jablonski (1987) is a removable mute which is attached over the top of the bridge and removed from the instrument when not in use. U.S. Pat. No. 2,475,055 to Shuh (1949) is a variant of the same muting concept. These mutes are designed as practice mutes and create only one tonal change. These mutes are also relatively heavy in comparison to other common mutes and may cause fatigue to the musician if used on the instrument for an extended period of time.

The foremost disadvantage of prior art mutes as they relate to the violin family of instruments is their ability to produce only one sound palette change. Furthermore, the palette change must be an aesthetically pleasing change reflecting a correct combination in the alteration of the tone and reduction of the volume of the instrument. Rubber and metal mutes have a reputation of creating a dull tone which is not aesthetically pleasing to many musicians. Wood and leather mutes create a generally pleasing sound. Leather mutes have the disadvantage of being very difficult to make and costly to produce and therefore costly to purchase.

A second disadvantage of prior art mutes is the skill level required by the musician to employ the mute effectively. Mutes that are easily attached or detached from the instrument are generally preferred to mutes having complex mechanics or non-intuitive mechanisms. Many prior art mutes require fixed installation, immediately excluding them from use by musicians who do not wish to permanently affix a mute to the instrument. Prior art mutes that rest between the bridge and the tailpiece are prone to rattling when the strings vibrate and have been known to fall off, both undesirable occurrences. Mutes that must be removed from the instrument when not in use are disadvantageous to musicians playing a musical composition in which there is little time allowance to engage the mute onto the bridge. Also detachable mutes are easily lost because of their small size.

SUMMARY OF THE INVENTION

It is an object of this invention to provide a three-position mute capable of creating more than one distinctive sound palette change while offering the musician ease of use in maneuvering the mute into three positions: first mode: pianissimo position, second mode: mezzo piano position and third mode; resting position One embodiment of the present invention provides a mute that can be attached to the instrument in various positions, providing the means for creating a range of sound palette changes. The mute of this invention uses precision-cut slots and notches that are cut in the underside of the mute so that the mute in a first mode (pianissimo) of use can be attached to the top of the instrument bridge and in a second mode (mezzo piano) of use can be placed up against the instrument bridge's side to create two distinctively different muting effects. The position, depth and angle of the notches also allow the mute to be positioned onto and guided along the two middle strings of the instrument so that the user can attach or detach the mute without looking directly at it. The space between the notches and the narrowness of the notches work in combination with the slight convergence of the strings as the strings extend from the bridge to the tailpiece, where the strings converge closer together, allow the mute to be pushed onto the strings where the resilience of the mute's composition and the frictional contact with the strings urging against the insides of the notches hold the mute in place. The notches are inclined in depth, allowing the mute to sit flush against the bridge in the mute's second mode of use and allowing the mute to be slid up and down the string length between the bridge and the tailpiece in a natural, easy flow of manual movement. When the bridge is utilized in its first mode of use on top of the bridge, the curved design of the underbelly of the mute allows the mute to sit on top of the bridge without the lower surface of the mute touching the second and third strings. The design further allows that the four legs do not touch the first or fourth strings when used in the first or second mode. The design of the mute relates to the generally accepted standard dimensions of string spacing, string diameter, string convergence, the angle of the strings over the bridge, bridge thickness, and the curvature of the top of the bridge which standard dimensions are well known in the field as set out by MENC (Music Educators National Conference) Standards incorporated herein by reference. These standards established in 1952 are generally followed in most modern stringed instruments, but variations do take place, sometimes with older instruments. The MENC Standards set out the spacing from center-to-center between the strings on the bridge for each size of stringed instrument, and the mutes of this invention for each size determine their element placement and width according to the size of the instrument on which the mute is to be used. By incorporating these dimensions as discussed below, the mute can be successfully used in all three positions, taking into account the generally accepted ranges of plus/minus tolerances of these dimensions so that the mute works in all situations. Intentional deviation from the accepted dimensions is rare as it usually makes the musical instrument harder to play for the musician and/or impairs the sound of the instrument.

Another aspect of the mute of this invention is that it can be firmly secured in the resting position when the mute is not in use as the notches and the width of the mute provide significant friction between the mute and the strings when the mute is moved to its resting position. In addition to the notches of the mute engaging the middle two strings of the instrument, the outer sides of the four legs of the mute exert outward pressure against the two outer strings of the instrument helping to secure the mute in its resting position. The tension of the strings in the notches and the inward pressure of the outer strings against the outside of the legs are due to the strings being positioned closer together as the strings approach the tailpiece and allow the mute to be suspended on the strings well in front of the bridge near the tailpiece when not in use while at the same time preventing rattling of the mute and obstruction to the musician. The teachings of the present invention describe the only three-position stringed instrument mute capable of creating two distinctive muting sound effects. When not in use, the mute of this invention allows the user to retain the mute on the instrument without causing significant interference with the overall functioning of the instrument. Furthermore, the dimensions and angles of the mute of this invention will accommodate the vast majority of violin-family instruments. While constructed of leather in a preferred embodiment, the mute of this invention can be constructed from an array of other materials.

DESCRIPTION OF THE PREFERRED EMBODIMENT(S)

Bowed stringed instruments utilize a bow drawn across the strings to produce vibrations which are transmitted through the bridge and amplified by the violin body. The strings are attached to the instrument body via the tailpiece and the pegs. The pegs are housed in the peg box of the scroll of the instrument which in turn is connected to the neck with the fingerboard thereon. The F holes in the violin body transmit the lower frequency sounds from the vibrating body of the instrument. Fine tuners on the tailpiece may be used to adjust the vibrating frequency of each string in combination with the tuning pegs. A chin rest can be used by the musician to more easily hold the instrument between the head and shoulder while playing. The description herein assumes the front of the instrument is at its tailpiece and the rear is at its scroll.

Figure 1:
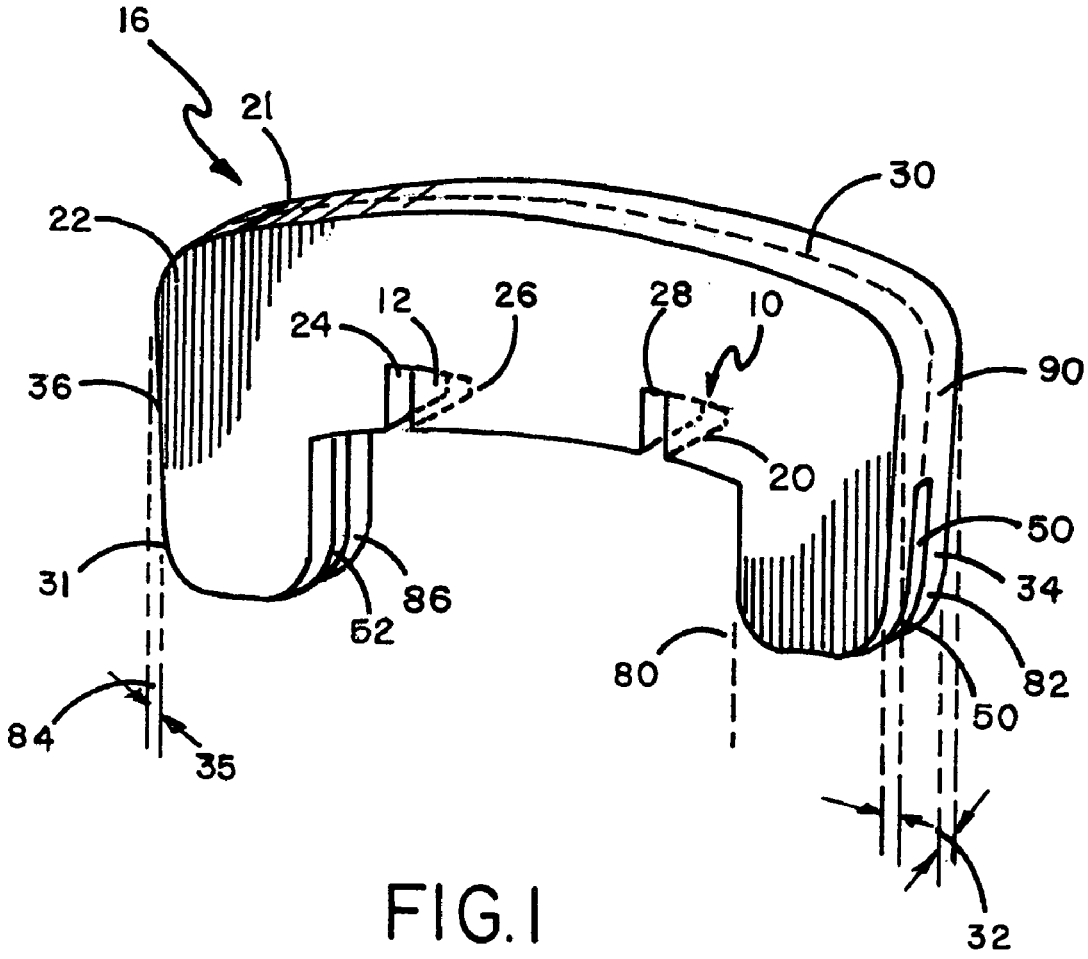
FIG. 1 illustrates a front perspective view of the mute of this invention.
Figure 2:
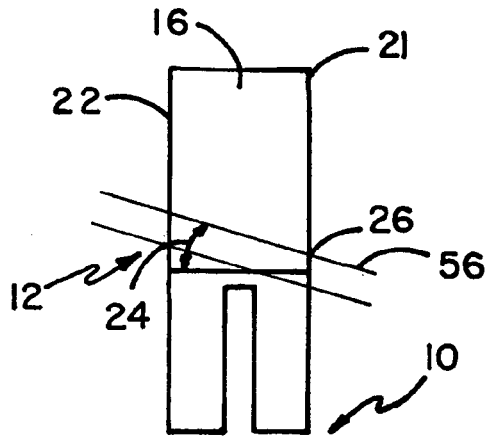
FIG. 2 illustrates a side sectional view through one of the slots showing a portion of a string disposed therein.
Figure 3:
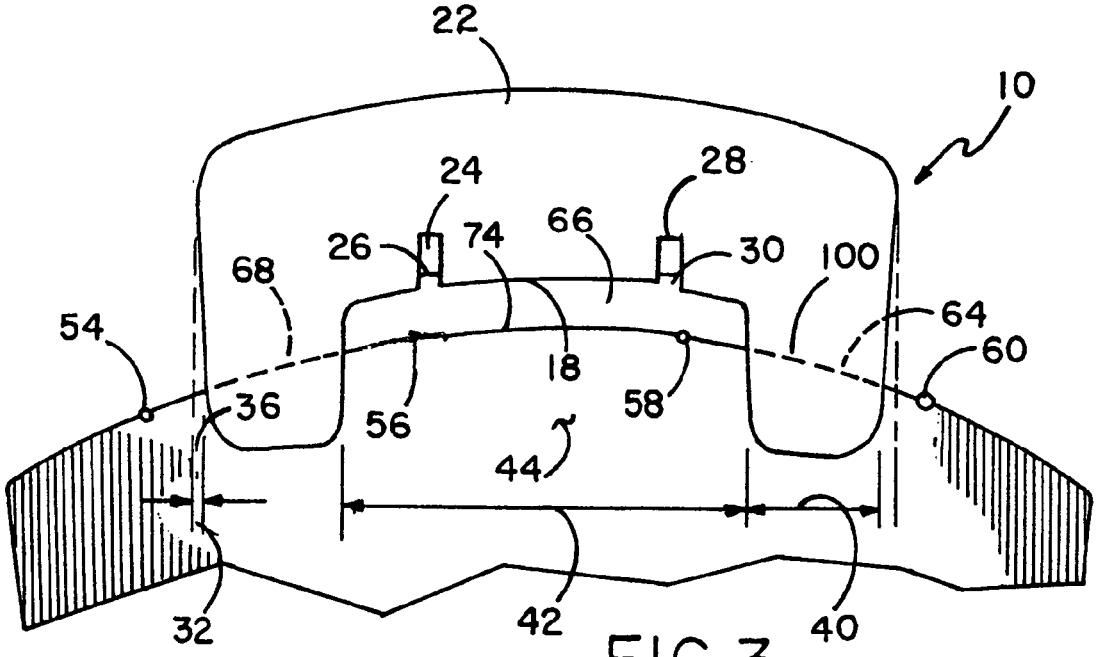
FIG. 3 illustrates a rear view of the mute of this invention.
Figure 5:
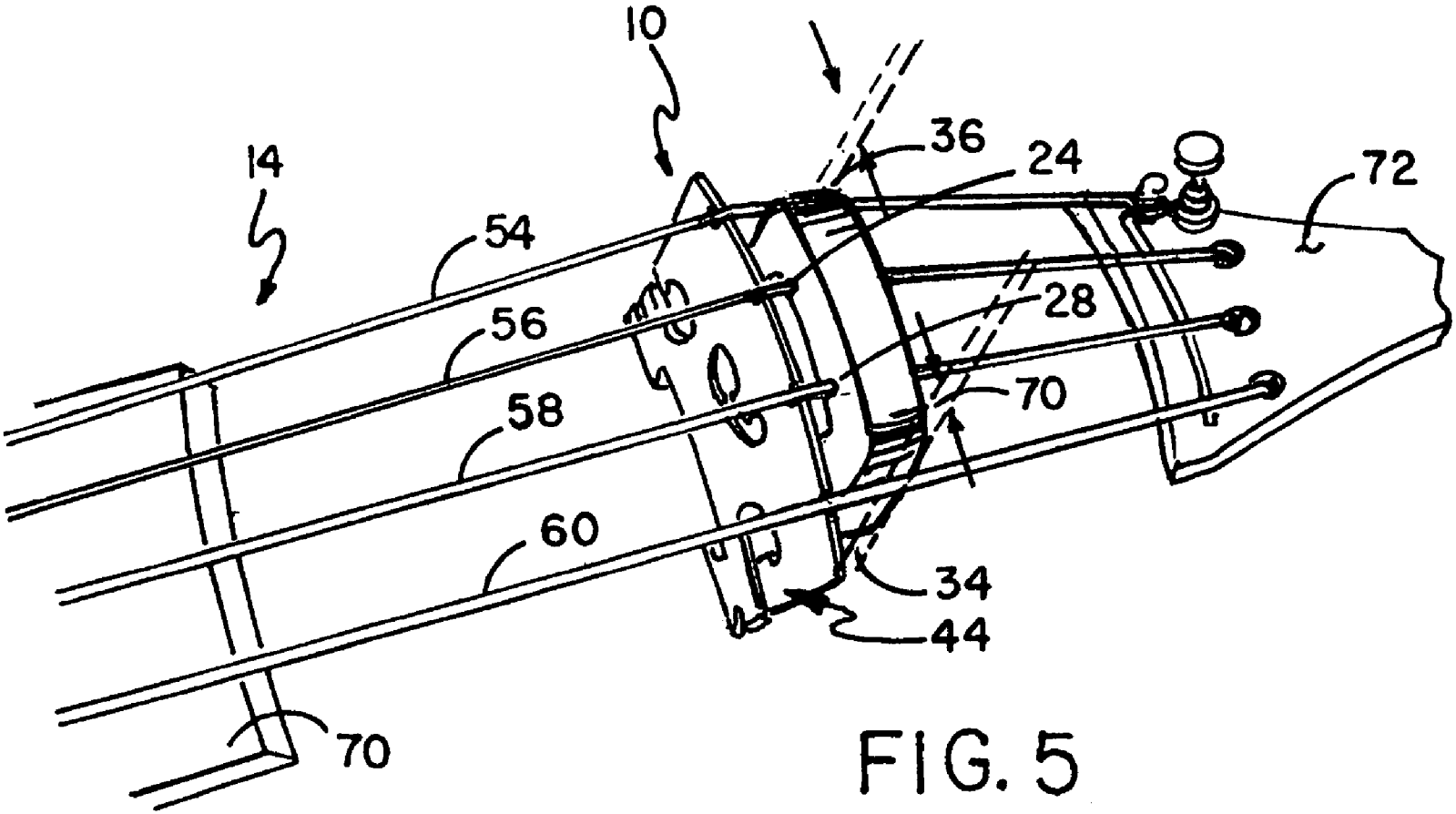
FIG. 5 illustrates a rear perspective view of the mute of this invention in its second mode of use position installed adjacent to, and contacting, the front face of the bridge.
Figure 6:
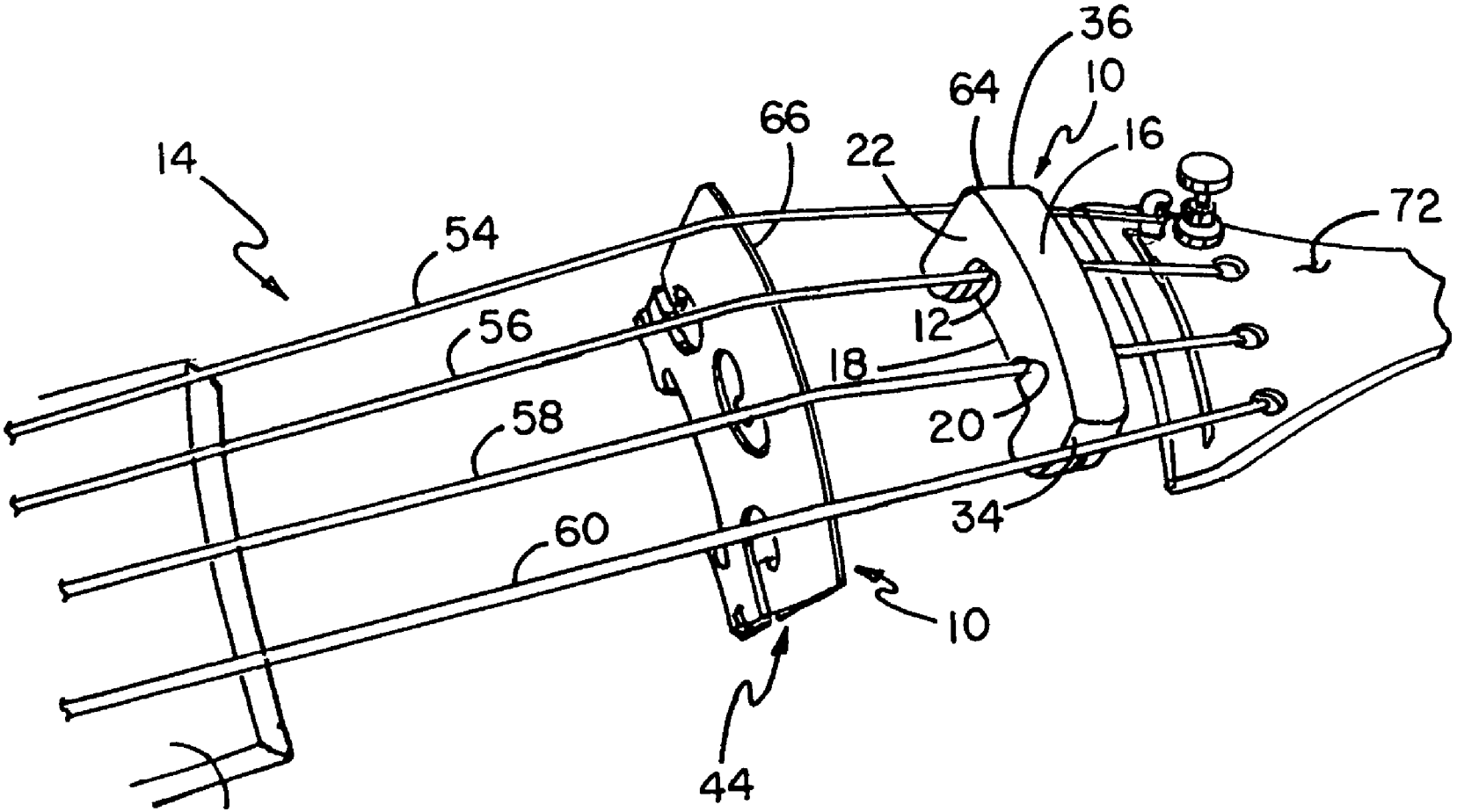
FIG. 6 illustrates a front perspective view of the mute of this invention in its resting third mode of use position installed on the violin strings between the bridge and the tailpiece.

FIG. 1 is a perspective view of mute 10 having upper portion 16 which provides the majority of the mute's mass and dampening action when the mute is utilized. First and second string notches 12 and 20 are cut into bottom of upper portion 16 of mute 10 for alignment and positioning, respectively, on second and third strings 56 and 58 in the mute's second mode of use and in its resting mode, as seen in FIGS. 5 and 6. The tops of first and second string notches 12 and 20 are defined at a 15 degree downward angular slope 23 from front 22 to rear 21 of the mute, as seen in FIGS. 1 and 2. First and second notches 12 and 20 each have an approximate width of 1.0 mm and a sloping depth being 1.6 mm in height at first and second fronts 24 and 28 to 0.5 mm to first and second rears 26 and 30. The inside tops of first and second notches 12 and 20 are angled so that they can be mounted and engaged flush on second and third strings 56 and 58, respectively, which strings also extend at a 15 degree downward slope to tailpiece 72 to position the mute's face parallel to the front of the bridge. In the mute's second mode of use the front 22 of mute 10 will be positioned substantially perpendicular to the top of the instrument and parallel to front face 62 of bridge 44 to better contact the front of the bridge. The spacing apart of first and second notches 12 and 20 depends on the size of the instrument. For example, on a full size 4/4 violin the strings near the bridge are approximately 11 mm apart from one another, and the first and second notches 12 and 20 on a mute to be used on a 4/4 violin are also approximately 11 mm apart from one another. Different spacing is used to match the distance between the notches to the distance between the second and third strings for fractional sized violins, violas and cellos. In the mute's first mode (pianissimo) of use portion 16 rests on top of the bridge. Four legs, being first leg 80, second leg 82, third leg 84 and fourth leg 86, extend below upper portion 16. Defined between first and second legs 80 and 82 is first bridge receipt slot 50, and defined between third and fourth legs 84 and 86 is second bridge receipt slot 52, said first and second bridge receipt slots 50 and 52 having tops 64 and 68, respectively. First and second bridge receipt slots 50 and 52 are each approximately 0.8 mm wide and have a depth of approximately 4.2 mm and extend generally toward the ends of curved base 18 and to a height somewhat below curved base 18. The height of tops 64 and 68 of first and second bridge receipt slots 50 and 52 are disposed lower than curved base 18 of upper portion 16 of the mute such that when the bridge is inserted into first and second bridge receipt slots 50 and 52, bridge top 74 does not contact curved base 18 of upper portion 16 nor does upper portion 16 contact the tops of the second and third string 56 and 58. First outer side 34 of first and second legs 80 and 82 and second outer side 36 of third and fourth legs 84 and 86 are tapered inwardly on their outer sides toward their bottoms and each leg is rounded at its bottom, creating first and second side angles 32 and 35, as seen in FIG. 3. FIG. 3 also shows the top of bridge 44 and strings 54, 56, 58 and 60 where curved base 18 does not contact the tops of strings 56 and 58 when the mute is in its first mode of use on bridge 44. The generally straight cut 100 in FIG. 3 of the tops of slots 50 and 52 is best for violins and violas while a more curved radial cut lower at the sides is best for cello mutes as it adds strength to the gripping ability of the mute legs to the bridge. In a preferred embodiment upper portion 16 and first, second, third and fourth legs 80, 82, 84 and 86 can be constructed of leather bends glued together at their center extending on axis 90 running from first and second receipt slots 50 and 52, as seen in FIG. 1. Leather has the advantage of adapting its shape to conform to the shape of the bridge and strings.

Figure 4:
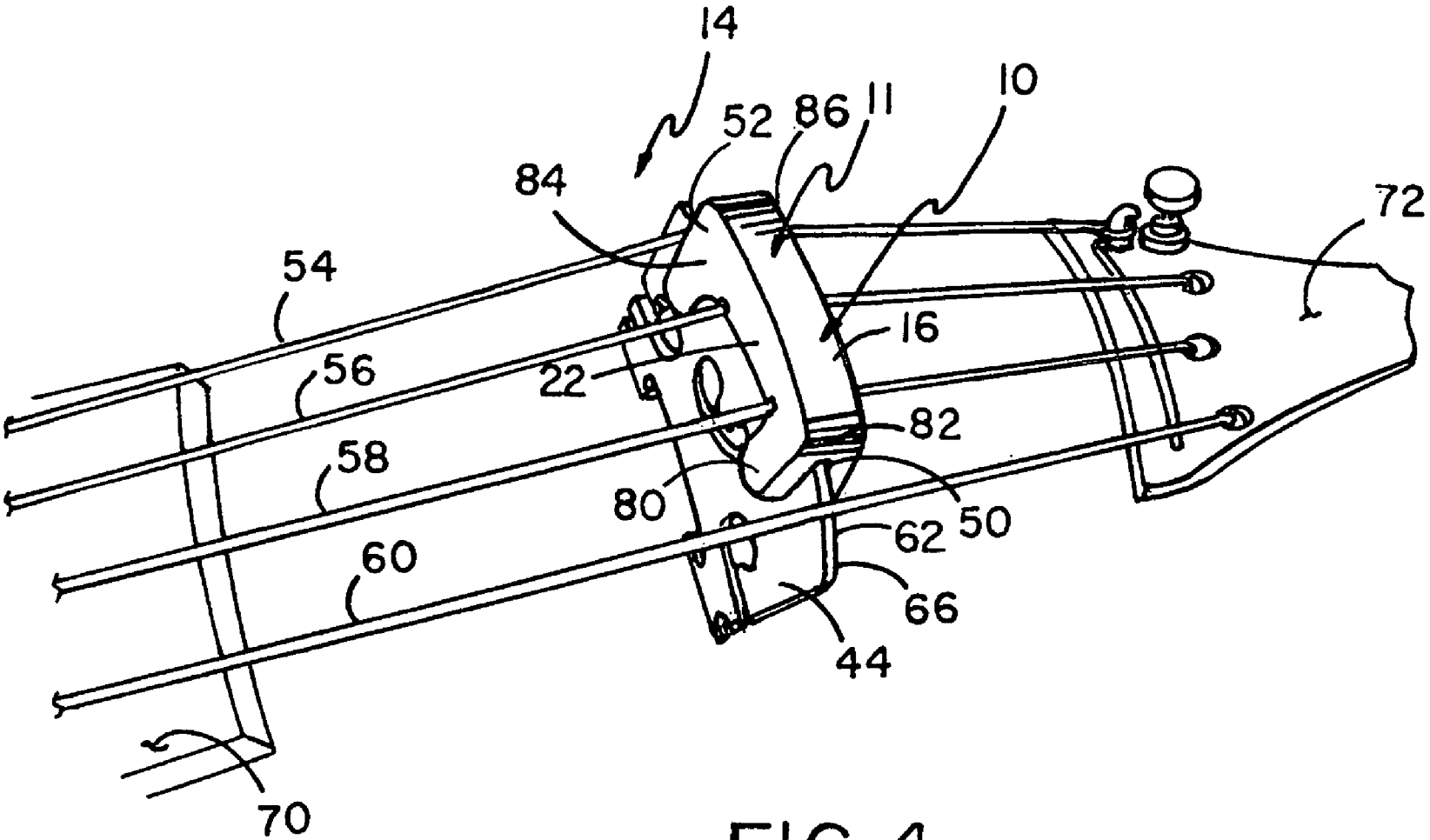
FIG. 4 illustrates a rear perspective view of the mute of this invention in its first mode of use position installed on a violin bridge.

FIG. 4 illustrates a front perspective view of the mute of this invention disposed in its first mode of use in which mute 10 is placed on top of bridge 44. First and second legs 80 and 82 on one side of the mute and third and fourth legs 84 and 86 on the other side engage bridge 44 within first and second receipt slots 50 and 52 and hold upper portion 16 on top of the bridge. Curved base 18 is curved in an arc that is generally of the same curvature as, and is generally parallel with, the curvature of upper arc 66 of bridge 44 such that the legs constrict the bridge's vibration. When the mute is placed onto the top of the bridge in its first mode of use relative to the music instruction, pianissimo muting occurs through the combined effect of the weight of the mute on the bridge plus the constriction of the four legs dampening the transmission of vibration through the bridge. The bridge supports the weight of the mute. Mezzo piano second mode muting occurs through the constricting effect of the surface of the mute (two legs plus partial body) against one side of the bridge dampening the transmission of the vibration through the bridge. The weight of the mute is supported by second string 56 and third string 58.

FIG. 5 is a front perspective view of the mute of this invention in its second mode (mezzo piano) of use in which the mute is placed up against front side 62 of bridge 44. It should be noted that first and second string notches 12 and 20 engage, respectively, second and third strings 56 and 58 of the instrument, and curved base 18 of the mute is slightly lower than upper arc 66 of instrument bridge 44. First and second outer sides 34 and 36 because of their respective inward angles 32 and 35 do not contact outer first and fourth strings 54 and 60.

FIG. 6 is a front perspective view of the mute of this invention in its resting third mode of use between bridge 44 and tailpiece 72 of the instrument. Mute 10 is held rigidly in its resting third mode of use by the combination of second and third strings 56 and 58 being inserted, respectively, in first and second string notches 12 and 20; and first and second outer sides 34 and 36 exerting outward pressure, respectively, against first and fourth strings 54 and 60. The tension engaging first and second string notches 12 and 20 onto second and third strings 56 and 58 along with the lateral pressure of first and fourth strings 54 and 60 against first and second outer sides 34 and 36 is sufficient to prevent the mute from being dislodged.

In operation, the musician uses the mute to achieve the desired volume change by placing the mute on top of the bridge in its first mode of use or flush against the front side of the bridge of the stringed instrument in its second mode of use, depending on the sound palette the musician wishes to achieve. When not is use, the mute can be either removed from the instrument or moved to its resting third mode of use position, as seen in FIG. 6.

When the mute is employed in its first mode of use as seen in FIG. 4, the following effects alter the tonal/volume quality of the stringed instrument:

1. First, second, third and fourth legs 80, 82, 84 and 86 are secured on top of bridge 44 by means of first and second bridge receipt slots 50 and 52 receiving bridge 44 tightly therein with consideration to the mute's upper portion weight and tightness of constriction of the mute's legs;
2. Mute upper portion 16 and first, second, third and fourth legs 80, 82, 84 and 86 restrict the vibrations originating from the instrument strings as the vibrations are transmitted through bridge to instrument body, thereby reducing the volume of the instrument and altering the tonal qualities; and
3. The placement of the mute on top of the bridge effectively increases the mass of the bridge, reducing the amplification characteristics of the instrument body by essentially changing the dimensions of the bridge.

When the mute is employed in its second mode of use, as seen in FIG. 5, the following effects alter the tonal/volume quality of the stringed instrument:

1. First and second string notches 12 and 20 secure the mute to second and third strings 56 and 58 and hold the mute firmly against the front face 62 of bridge 44 with consideration to the mute's weight with less constriction on the bridge as the mute is merely pressing against the bridge with the weight of the mute supported by the second and third strings; and
2. Part of mute upper portion 16 and first and third legs 80 and 84 press against front face 62 of bridge 44 to restrict vibration originating from the strings from traveling to the instrument body, thereby reducing the volume of the instrument and altering its tonal qualities.

When returned to its third mode of use being its resting position, as seen in FIG. 6, and not in use, the mute does not interfere with the functionality of the stringed instrument due to the following:

1. The mute is constructed of lightweight material such as leather in a preferred embodiment and does not significantly increase the overall weight of the instrument;
2. First and second string notches 12 and 20 provide friction and create sufficient tension between the mute and the strings to retain the mute in its resting position; and
3. First, second, third and fourth legs 80, 82, 84 and 86 provide friction and create sufficient tension between the mute's first and second outer sides 34 and 36 and first and fourth strings 54 and 60 to retain the mute in the desired position.

Should the performer wish to move or detach the mute from the stringed instrument, he/she lifts the mute off the strings or the bridge depending on the mute's position.

Although the present invention has been described with reference to particular embodiments, it will be apparent to those skilled in the art that variations and modifications can be substituted therefor without departing from the principles and spirit of the invention.

I claim:

1. A mute for a stringed instrument of the type having a top, a bridge having a thickness, a tailpiece, peg box, and first, second, third and fourth strings, each of said strings having a top, a width, said strings resting in a spaced apart position on said bridge disposed upon said top of said instrument, said bridge having a top arc, a front face facing said tailpiece and a rear face facing said peg box with a thickness defined between said front face and said rear face, said strings extending from said peg box to said tailpiece over said bridge forming a string angle from the top of said bridge to said tailpiece, each of said strings further extending at its convergence angle toward one another as they extend from said bridge to said tailpiece, comprising:

an elongated body having a first side, a second side, first end, second end, a top and a bottom;

first and second legs extending from said bottom of said elongated body at said first end, said first and second legs each having an inner side and an outer side;

third and fourth legs extending from said bottom of said elongated body at said second end, said third and fourth legs each having an inner side and an outer side;

a first slot defined between and separating said first and second legs, and a second slot defined between and separating said third and fourth legs, said first and second slots each having a width, said width of each of said first and second slots being somewhat narrower than said thickness of said bridge;

first and second notches defined parallel to one another in the bottom of said elongated body, said first and second notches extending from said first side of said elongated body to said second side of said elongated body, said first and second notches being formed deeper at said first side of said elongated body than at said second side of said elongated body, said first and second notches each having a top, the top of each notch extending at an angle being the same angle as each of said string's string angle from said bridge to said tailpiece, said first and second notches defined within said elongated body for receiving, respectively, said second and third strings within each of said first and second notches, said first notch having an approximate width of said second string, said second notch having the approximate width of said third string, with such strings extending through said notches at their convergence angles for causing said tops of said first and second notches to fully contact and exert retention pressure on said second and third strings for aiding in holding said mute in place on said strings as said strings extend therethrough at their convergence angles while said first and second ends of said elongated body and said outer sides of said first and second legs and said third and fourth legs do not extend sufficiently to contact, respectively, said first and fourth strings when said mute is positioned with said second and third strings engaged, respectively, within said first and second notches, and said first side of said mute is pushed against said front face of said bridge in a second mode of use position;

said mute positionable in a first position on top of said bridge, said bridge received within said first and second slots, respectively, between said first and second legs and said third and fourth legs in frictional engagement therewith said first and second legs and said third and fourth legs exerting pressure on said front and rear faces of said bridge; and said mute further having a resting position when moved from said second mode of use in a position on said second and third strings toward said tailpiece, said second and third strings being received into said first and second notches at a position near said tailpiece with said first and fourth strings then contacting, respectively, said first and second sides of said elongated body of said mute for applying frictional pressure to said mute along with the frictional pressure of said second and third strings engaged in said first and second notches for retaining said mute in said resting position.

2. The mute of claim 1 wherein said bottom of said elongated body is arched conforming in shape to said top arc of said bridge and when in said first mode of use position, said bottom of said elongated body does not contact said second and third strings and the outside of the legs do not touch said first and fourth strings.

3. A method of muting a stringed instrument of the type having a top, a bridge having a top, a thickness, a tailpiece, peg box, and first, second, third and fourth strings, each of said strings having a width, said strings resting in a spaced apart position on said bridge disposed upon said top of said instrument, said bridge having a top arc, a front face facing said tailpiece and a rear face facing said peg box with a thickness defined between said front face and said rear face, said strings extending from said peg box to said tailpiece over said bridge forming a string angle from the top of said bridge to said tailpiece, each of said strings further extending at its convergence angle toward one another as they extend from said bridge to said tailpiece, comprising the steps of:

providing an elongated body having a first side, a second side, first end, second end, a top and a bottom;

extending first and second legs from said bottom of said elongated body at said first end, said first and second legs each having an inner side and an outer side;

extending third and fourth legs from said bottom of said elongated body at said second end, said third and fourth legs each having an inner side and an outer side;

forming a first slot defined between and separating said first and second legs, and forming a second slot defined between and separating said third and fourth legs, said first and second slots each having a width;

defining said width of each of said first and second slots somewhat narrower than said thickness of said bridge;

forming first and second notches defined parallel to one another in the bottom of said elongated body, said first and second notches extending from said first side of said elongated body to said second side of said elongated body;

defining said first and second notches deeper at said first side of said elongated body than at said second side of said elongated body, said first and second notches each having a top;

extending said tops of said first and second notches at an angle being the same angle as each of said string's string angle from said bridge to said tailpiece;

receiving, respectively, said second and third strings within each of said first and second notches, said first notch having an approximate width of said second string, said second notch having the approximate width of said third string;

extending said second and third strings through said first and second notches at their convergence angles;

causing said tops of said first and second notches to fully contact said second and third strings for aiding in holding said mute in place on said strings as said strings extend therethrough at their convergence angles;

exerting frictional pressure by said first and second strings contacting said sides of said first and second notches for retaining said mute on said second and third strings;

preventing contact of said first and second ends of said elongated body and said outer sides of said first and second legs and said third and fourth legs with said first and fourth strings by not extending said mute's elongated body and outer sides sufficiently to contact, respectively, said first and fourth strings when said mute is positioned with said second and third strings engaged, respectively, within said first and second notches;

pushing said first side of said mute flush against said front face of said bridge into a second mode of use position;

repositioning said mute in a first mode of use position on top of said bridge;

receiving said bridge within said first and second slots, respectively, between said first and second legs and said third and fourth legs;

frictionally engaging said bridge within said first and second legs and said third and fourth legs by said legs exerting pressure on said front and rear faces of said bridge;

repositioning said mute in a resting third mode of use position by moving said mute from said first mode of use position or second mode of use position into a position on said second and third strings nearer said tailpiece than said bridge;

receiving said second and third strings in said first and second notches at a position near said tailpiece;

contacting said first and fourth strings, respectively, against said first and second sides of said elongated body and said outer sides of said first, second, third and fourth legs of said mute; and applying frictional pressure to said mute by contact with said first and fourth strings along with said frictional pressure of said second and third strings engaged in said first and second notches for retaining said mute in said resting third mode of use position.

4. The method of claim 3 further including the step of:

positioning said bottom of said elongated body so as not to contact said second and third strings, said elongated body being arched and conforming in shape to the shape of said top arc of said bridge, when said mute is in said first mode of use position and the outside of the legs do not touch said first and fourth strings.

* * * * *